US005785126A

United States Patent [19]

Olsson

[11] Patent Number: 5,785,126

[45] Date of Patent: Jul. 28, 1998

[54] METHOD OF EXTINGUISHING OF FIRE IN OPEN OR CLOSED SPACES AND MEANS FOR PERFORMING THE METHOD

[75] Inventor: Ove Olsson, Kungälv, Sweden

[73] Assignee: Svenska Skum AB, Sweden

[21] Appl. No.: 633,762

[22] PCT Filed: Oct. 21, 1994

[86] PCT No.: PCT/SE94/00995

§ 371 Date: Apr. 23, 1996

§ 102(e) Date: Apr. 23, 1996

[87] PCT Pub. No.: WO95/11725

PCT Pub. Date: May 4, 1995

[30] Foreign Application Priority Data

Oct. 25, 1993 [SE] Sweden ..... 9303500

[51] Int. Cl.[6] ..... A62C 35/58

[52] U.S. Cl. ..... 169/46; 169/15

[58] Field of Search ..... 169/46, 15

[56] References Cited

U.S. PATENT DOCUMENTS

| | | | |
|---|---|---|---|
| 2,601,899 | 7/1952 | Boerner | 169/15 |
| 3,356,148 | 12/1967 | Jamison | 169/15 |
| 3,702,158 | 11/1972 | Livingston et al. | 169/15 |
| 3,795,368 | 3/1974 | Larah | 169/15 |
| 4,805,700 | 2/1989 | Hoover . | |

FOREIGN PATENT DOCUMENTS

| | | | |
|---|---|---|---|
| 30771 | 7/1960 | Finland . | |
| 412317 | 3/1980 | Sweden . | |
| 1161122 | 6/1985 | U.S.S.R. | 169/15 |
| 92/22353 | 2/1992 | WIPO . | |

*Primary Examiner*—Gary C. Hoge

*Attorney, Agent, or Firm*—Lerner, David, Littenberg, Krumholz & Mentlik

[57] ABSTRACT

The invention relates to a method of extinguishing fires in closed or open spaces using water and foam. The method is characterized in that water mist is first produced with the air available in the space without air supply from outside until the temperature in the combustion gases has fallen below a predetermined level or during a predetermined period of time, whereupon foam is produced with the air available in the space without air supply from outside and with a suitable speed for filling the space and extinguishing the fire. The invention also includes a means for performing the method comprising units for producing water mist and foam in the space and a closing or controlling valve (33) which, in dependence upon the temperature in the combustion gases or period of time elapsed from the start of the water mist production, controls the amount of foam liquid added to the water.

8 Claims, 2 Drawing Sheets

METHOD OF EXTINGUISHING OF FIRE IN OPEN OR CLOSED SPACES AND MEANS FOR PERFORMING THE METHOD

BACKGROUND OF THE INVENTION

1. Field of the Invention

The present invention relates to a method and a means for extinguishing fires in open or closed spaces using water and foam. The method is especially suitable for extinguishing fires in factories, ships, road tunnels etc. where mist and foam units and further means may be permanently mounted.

2. Description of the Prior Art

It is known to use water also in the form of water mist and foam when extinguishing fires in different spaces. Also, different forms of non-combustible gases such as carbon dioxide and halones are used for this purpose.

In spaces which are regarded as being fire hazardous and which have been prepared for extinguishing of possible fires, water can be introduced for example by means of sprinklers. When the sprinkler water has a low pressure it will flow out in the form of a shower, whereas when it has a high pressure water mist will be produced. This water mist is produced both as a result of the high pressure and as a result of the water being ejected against a net or the like. The water then suitably has a pressure of 6 bar.

The water mist can also be made in units with a lower water pressure of for example 1.5 bar, whereby large amounts of air have to be blown into the unit from outside. Foam is produced in the same way, although pure water is then not used, but instead water to which a foaming agent has been added.

Foam for extinguishing purposes can also be made by means of special portable containers but the foam is then produced in another way than above.

Although the aforementioned extinguishing systems can extinguish most fires, they are, however, not perfect. It has i.a. shown itself to be the case that the hot combustion gases are the main cause of large scale damage from fires. It is therefore necessary to cool the combustion gases down quickly with normal sprinkler systems producing water droplets as well as water mist, the combustion gases are cooled effectively and, if the sprinkler system is combined with foam extinguishing, so-called pool fires can be extinguished. The expression pool fires includes fires which occur for instance on a floor in the shape of, for example, a burning liquid pool. This extinguishing system can however not cope with hidden fires, for example fires which occur in articles in a pile of pallets.

Only foam can extinguish all fires but the foam cannot cool the combustion gases so that the damage due to these hot combustion gases will occur anyway.

It has therefore been a long-felt want to be able to extinguish all types of fires and achieve a quick cooling of the combustion gases resulting in minimal damage.

Besides the above-mentioned problems the difficulty of arranging an automatic and hence quick action of the extinguishing system also arises since a risk exists that this can kill or seriously injure persons which are present in the burning space. Only foam can have this effect, whereas on the other hand water mist does not have this effect.

Some gases, of the Halon type and possible substitute agents, do not kill or seriously injure people, but since releasing a gaseous system largely means that all available extinguishing gas in the space is released, a new release cannot occur until after refilling. Other gases of the carbon dioxide type or other inert gases cannot be used in spaces where people are present due to the inherent reduction of oxygen.

SUMMARY OF THE INVENTION

According to the present invention the problem associated with the aforementioned systems has been solved and a method for extinguishing fires in closed or open spaces using water and foam has been achieved, which method is characterized in that the water mist is initially produced without air supply from outside with the available air in the space until the temperature in the combustion gases has been lowered below a predetermined level or during a predetermined period of time, whereupon foam is produced in the space without air supply from outside and at a suitable speed for filling the space and extinguishing the fire.

According to the invention the foam production should start after a certain period of time of water mist production, for example about 30 seconds.

According to the invention, the foam production may start in dependence upon the temperature in the combustion gases when this has been lowered to a suitable level of, for example, 300°–400° C.

According to the invention the foam should be produced in such an amount that the level of foam in the space rises at a speed of at least approximately 1.5 meters/minute.

The invention also includes a means for performing the method comprising possibly one or more fire indicators in the space which is to be fire-protected, one or more units for producing water mist and/or foam using the air available in the space without air supply from outside, and pipes for supply of water or foam liquid to the units, which means is characterized by a closing or controlling valve which is controlled in dependence upon the temperature in the combustion gases or by the time which has elapsed from the start of the water mist production in a pipe from the foam liquid tank to the supply pipe(s) for water to the units.

Using this proposed system, water mist is accordingly first used to lower the temperature of the combustion gases and quickly control the fire. After having checked that all persons are safe, the addition of foam liquid is triggered so that the foam level in the space quickly starts rising and a complete fire extinguishing is effected.

BRIEF DESCRIPTION OF THE FIGURES

The invention will now be described in more detail with reference to the drawings, in which.

DESCRIPTION OF THE PREFERRED EMBODIMENT

Figure 1:
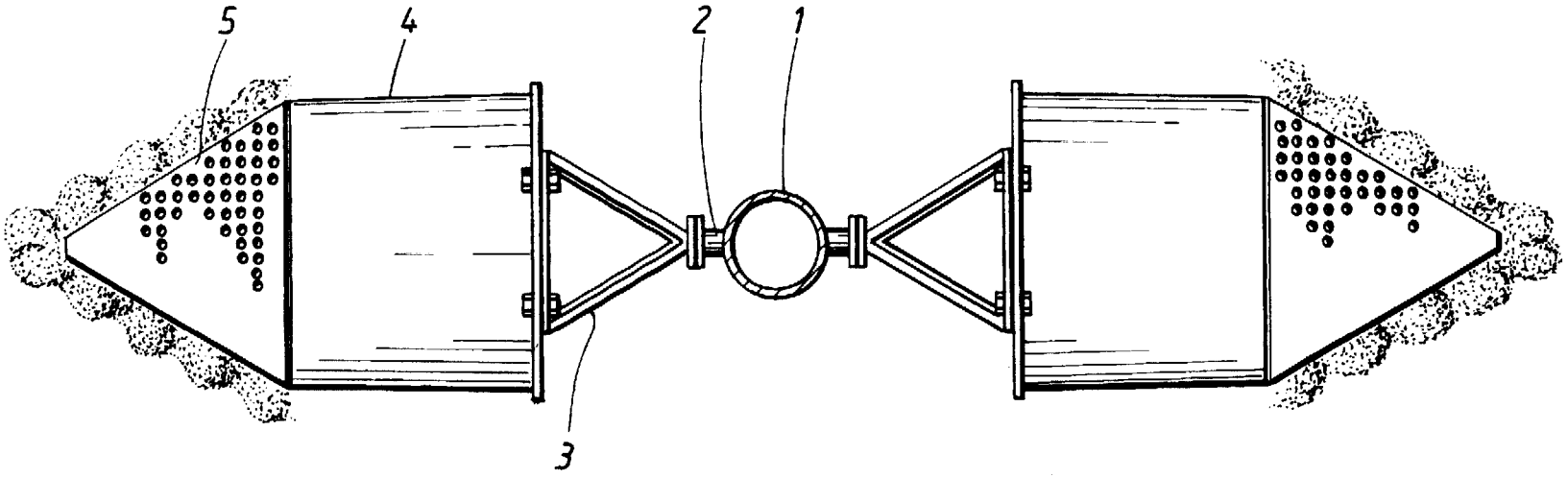
FIG. 1 shows a side view of a foam and mist unit respectively seen from the side.
Figure 2:
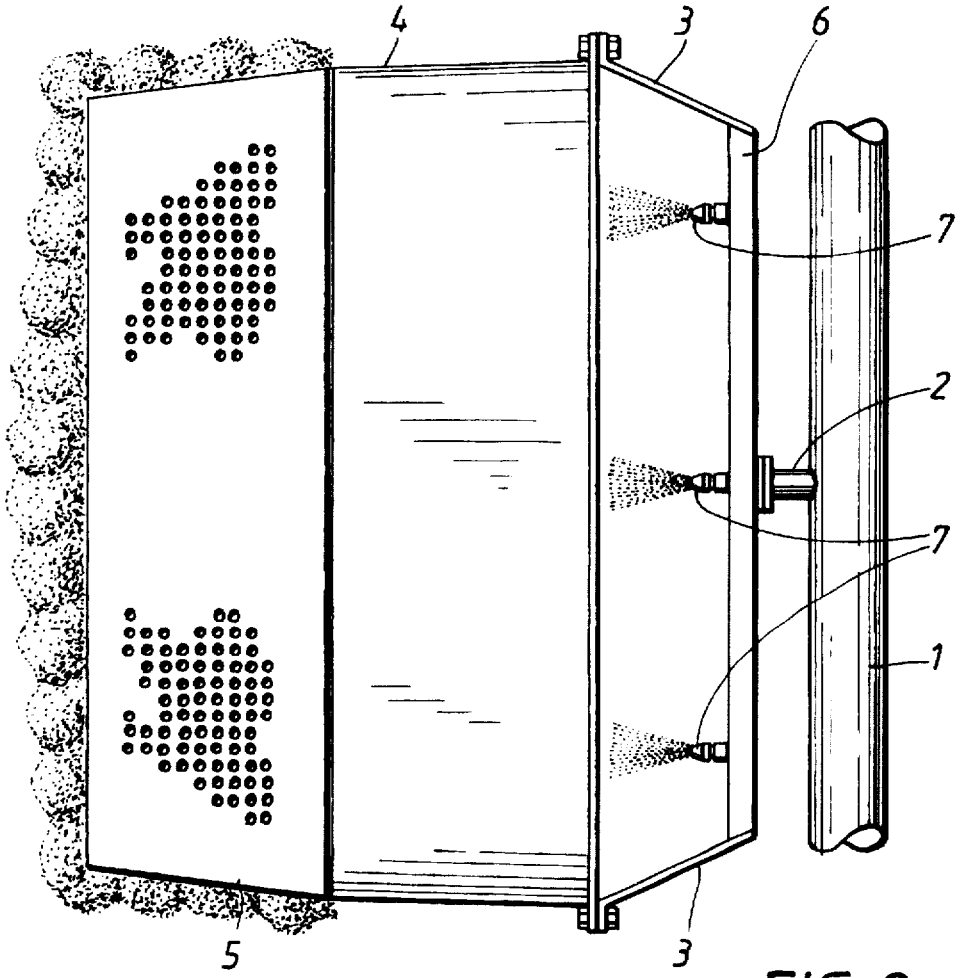
FIG. 2 shows the same unit seen from above or below and FIG. 3 shows schematically the supply means for water and foam liquid respectively.

FIG. 1 shows a unit consisting of a supply pipe 1 which is shown in section and which has a branch pipe 2 for supply of water to the ejection nozzles which are shown in more detail in FIG. 2. FIG. 1 further shows a support 3 on which a container 4 being open at both long sides has been attached. On one long side, however, a net 5 in the shape of an elongated cone has been attached. When water having a high pressure coming from the pipes 1 and 2 is ejected out to the left in FIG. 1 into the box 4 and further against the net 5, small droplets are formed on the net producing a water mist.

FIG. 2 shows the same arrangement as in FIG. 1 seen from above or from below and the same references denote the same elements as in FIG. 1. Furthermore, FIG. 2 more clearly also shows a pipe 6 which is connected to the pipe 2 and three nozzles 7 for the water ejection.

If instead of pure water a mixture of water and a foam agent is ejected through the nozzle 7 a foam is formed on the net 5. The foam agent can, according to the invention, be a conventional one, for example an agent which is marketed under the tradename Hot-Foam. This agent is suitably added in a concentration of 2% to the water.

Figure 3:
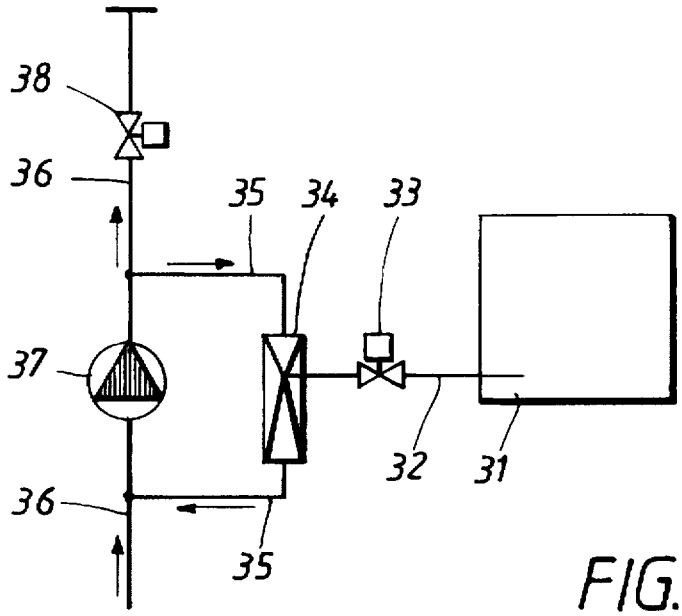

FIG. 3 shows schematically an example of the supply of water and foaming agent according to the invention. In the drawing a container for foaming agent 31 is shown. From this a pipe 32 leads to a valve 33 whereafter the pipe 32 ends in an ejector 34. Water is flowing through this ejector in the direction of the arrows through the pipes 35, said pipes being connected to the main supply pipe 36 to the unit or units. In this pipe 36 a pump 37 and a valve 38 are also shown.

When a fire starts in a space in which the unit according to FIGS. 1 and 2 is mounted this will be indicated in some way suitably by means of a fire sensor in the space and a water stream is started in the pipe 36, and this water is arranged to make the water mist by the unit according to FIGS. 1 and 2. When the combustion gases have been cooled down to a predetermined temperature of, for example, 300°–400° C., or a certain time has elapsed after the start of the water mist, for example 30 seconds, the valve 33 in the pipe 32 is opened and foam liquid from the container 31 will then flow into the ejector 34 due to the vacuum which exists there and mix together with the water stream. This will then flow further in the pipe 36 together with the fresh water. The valves 38 and 33 are adapted to give a suitable amount of foaming liquid to the water, for example 2%.

More units can suitably be arranged in the space depending upon its size and its shape. So much foam should however be made that the level of foam which starts from the floor should rise with a speed of at least 1.5 meters/minute. The amount of foam which is usually produced by a unit is about 60 $m^3$/minute and the number of units must then be adapted to this. Also other types of units can be used, for example those according to FIGS. 1 and 2 stacked on each other and united in two or three levels.

The means for the supply of water and water/foaming agent respectively can be constructed in a number of ways. The common aspect for the means must, however, be that a valve similar to the one which is denoted 33 in the FIG. 3 must be present in the pipe from the foaming liquid container.

The method according to the present invention combines the greatest advantages with earlier known systems such as water mist, sprinklers, gas and foam and also entraps the harmful combustion gases in the foam and cleans them. Due to the fact that no air is blown into the system or the space, no combustion gases will be released since those, as mentioned above, are entrapped in the foam.

The system can also extinguish hidden fires, it requires less water capacity per surface unit compared to, for example, sprinklers, it brings about a cooling effect and it can easily be started and stopped and also tested.

The system includes no moving parts and requires no air for the units and it is easy to maintain and install.

The invention is not limited to the embodiment shown but can be varied in different ways within the scope of the claims.

I claim:

1. A method for extinguishing a fire in a closed or open space using water and foam, comprising the steps of:

(a) initially producing water mist using air available in the space until a predetermined period of time elapses; and (b) after the predetermined period of time elapses, producing foam in the space using air available in the space at a suitable speed for filling the space and extinguishing the fire.

2. A method as claimed in claim 1, wherein said predetermined period of time is approximately 30 seconds.

3. A method as claimed in claim 1, wherein the step of producing foam comprises producing foam in such an amount that a foam level in the space rises with a speed of at least approximately 1.5 meters/minute.

4. A method for extinguishing a fire in a closed or open space using water and foam, comprising the steps of:

(a) initially producing water mist using air available in the space until a temperature of combustion gases of the fire has dropped to a predetermined temperature; and (b) after the temperature in the combustion gases has dropped to a predetermined temperature, producing foam in the space using air available in the space at a suitable speed for filling the space and extinguishing the fire.

5. A method as claimed in claim 4, wherein said predetermined temperature is between approximately 300° C. and approximately 400° C.

6. A method as claimed in claim 4, wherein the step of producing foam comprises producing foam in such an amount that a foam level in the space rises with a speed of at least approximately 1.5 meters/minute.

7. Apparatus for extinguishing fires in open or closed spaces using water and foam, comprising:

(a) at least one fire indicator in the space to be protected;

(b) at least one unit for production of water mist and foam without air supply from outside;

(c) a water supply pipe for supply of water to said at least one unit;

(d) a foam liquid supply pipe for supply of foam liquid to said water supply pipe; and (e) a control valve in said foam supply pipe for controlling the supply of foam according to a temperature of combustion gases produced by the fire.

8. Apparatus for extinguishing fires in open or closed spaces using water and foam, comprising:

(a) at least one fire indicator in the space to be protected;

(b) at least one unit for production of water mist and foam without air supply from outside;

(c) a water supply pipe for supply of water to said at least one unit;

(d) a foam liquid supply pipe for supply of foam liquid to said water supply pipe; and (e) a control valve in said foam supply pipe for controlling the supply of foam according to an elapsed period of time from the start of water mist production.

* * * * *